US012528657B2

(12) United States Patent
Monhemius

(10) Patent No.: US 12,528,657 B2
(45) Date of Patent: Jan. 20, 2026

(54) SHEET TRANSPORT DEVICE COMPRISING AN ENDLESS TRANSPORT BELT

(71) Applicant: CANON KABUSHIKI KAISHA, Tokyo (JP)

(72) Inventor: Maarten A. Monhemius, Eindhoven (NL)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 18/618,978

(22) Filed: Mar. 27, 2024

(65) Prior Publication Data

US 2024/0327160 A1 Oct. 3, 2024

(30) Foreign Application Priority Data

Mar. 29, 2023 (NL) ..... 2034463

(51) Int. Cl.
*B65H 5/22* (2006.01)
*B41J 11/00* (2006.01)
*B65H 11/00* (2006.01)

(52) U.S. Cl.
CPC ..... *B65H 11/005* (2013.01); *B65H 5/224* (2013.01); *B65H 2301/36132* (2013.01); *B65H 2404/25* (2013.01)

(58) Field of Classification Search
CPC ..... B41J 11/007; B41J 11/0085; B65H 5/224; B65H 5/024; B65H 29/242; B65H 2511/512; B65H 43/00; B65H 43/08; B65H 7/02; B65H 7/14; B65H 3/124; B65H 11/005
See application file for complete search history.

(56) References Cited

U.S. PATENT DOCUMENTS 6,721,528 B1 * 4/2004 Schreieder ..... G03G 15/755 399/302
7,905,346 B2 * 3/2011 Enomoto ..... G03G 15/1615 198/807
8,478,175 B2 * 7/2013 Murai ..... G03G 15/168 399/303

(Continued)

FOREIGN PATENT DOCUMENTS

CN 202556927 U 11/2012
CN 214295067 U 9/2021
EP 4094949 A1 11/2022

*Primary Examiner* — Luis A Gonzalez
(74) *Attorney, Agent, or Firm* — Canon U.S.A., Inc. IP Division

(57) ABSTRACT

A method of printing having the steps of transporting a print medium along a print station for printing on the print medium by means of an endless, air permeable transport belt positioned over a suction device for applying an underpressure to the print medium on the transport belt, wherein the transport belt comprises endless, non-permeable strips positioned between air permeable areas provided with openings and the suction device comprises a plurality of spaced apart support beams extending substantially in a main transport direction defined by the print station for supporting the transport belt; and controlling the position and/or orientation of the transport belt for aligning the print medium with respect to the print station, wherein each adjustment to the transport belt's position and/or orientation is restricted, such that the strips are maintained entirely overlapping the support beams.

16 Claims, 6 Drawing Sheets

(56) References Cited

U.S. PATENT DOCUMENTS

| | | | | |
|---|---|---|---|---|
| 2002/0193191 | A1* | 12/2002 | Downing | B41J 11/007 474/103 |
| 2012/0006215 | A1* | 1/2012 | DeJong | G03G 15/1615 101/481 |
| 2012/0255836 | A1* | 10/2012 | Blanchard | B65H 20/12 198/804 |
| 2015/0336406 | A1 | 11/2015 | Hobo | |
| 2016/0137447 | A1 | 5/2016 | Smeyers | |
| 2016/0142571 | A1* | 5/2016 | Smeyers | B65H 7/20 358/1.12 |
| 2021/0101391 | A1* | 4/2021 | Van De Sande | B41J 13/08 |

* cited by examiner

SHEET TRANSPORT DEVICE COMPRISING AN ENDLESS TRANSPORT BELT

CROSS-REFERENCE TO RELATED APPLICATIONS

This application claims the benefit of Netherlands Patent Application No. 2034463, filed Mar. 29, 2023, which is hereby incorporated by reference herein in its entirety.

BACKGROUND

1. Field of the Disclosure

The disclosure relates to a method of printing, a printer, and a computer-readable storage medium storing a computer program for performing the method on the printer.

2. Description of Background Art

Sheet printers may comprise an endless transport belt opposite an inkjet print station. The transport belt is provided with openings and extends over a suction device, which allows a negative pressure to be applied to a print medium on the transport belt, such that the print medium is adhered to and transported along with the transport belt. The suction device comprises a plurality of support beams in contact with an inner surface of the transport belt, which prevent the transport belt from being drawn into the suction device. This ensures flatness of the print medium while printing on it. The position and orientation of the transport belt are continuously sensed and adjusted, such that the transport belt remains aligned with respect to the print station. Despite this, it was found that over longer periods of continued operation, the number of print artifacts increased, specifically with regard to the alignment of the image on the print medium.

SUMMARY

The disclosure is directed to providing an improved method of printing, which improves print quality and/or device lifetime.

In accordance with the present disclosure, a method, a printer, and computer-readable storage medium storing a computer program are provided.

The method comprises the steps of:

- transporting a print medium along a print station for printing on the print medium by means of an endless, air permeable transport belt positioned over a suction device for applying an underpressure to the print medium on the transport belt, wherein the transport belt comprises endless, substantially non-permeable strips positioned between areas provided with openings and the suction device comprises a plurality of spaced apart support beams extending in a main transport direction defined by the print station, wherein the support beams support the transport belt. The method further comprises the step of:
- controlling the position and/or orientation of the transport belt to align the print medium with respect to the print station, wherein each adjustment to the transport belt's position and/or orientation is restricted, such that the strips are maintained entirely overlapping the support beams.

It is the insight of the inventor that over time ink deposition on the support beams results in a different frictional interaction between the support beams and the transport belt as compared to the initial state of the printer, causing adjustments of the transport belt on ink covered support beams to have different results as compared to 'clean' support beams. It is the further insight of the inventor that this ink deposition on the support beams can be prevented by ensuring that the support beams are constantly covered by a non-permeable material. It was found that the ink deposition was the result of an "ink mist" of fine droplet building up between the print station and the belt during printing, which ink mist lingered, so that ink deposition could occur, even when the print station was prevented from printing. The negative pressure draws the ink mist along the support beams into the suction device. Any adjustments to the position and/or orientation of the transport belt are made, such that the non-permeable strips are over the support beams. The permeable areas are prevented from moving over the top surface of any of the support beams. The full top surface (i.e. the surface in contact with the transport belt and facing the print station) of the support beams remains entirely covered by the non-permeable strip, preventing ink droplets from reaching the top surface. As such, the top surface of the support beams, which forms the contact surface with the transport belt, maintains its original properties. This ensures that the transport belt responds consistently to any corrective adjustment. Thereby, proper alignment of the image on the print medium on the transport belt is improved. Lifetime of the transport belt is further improved, as the interface between the support beams and the transport belt is free of ink contamination, which would otherwise cause abrasion of the transport belt. Thereby the object of the present disclosure has been achieved.

More specific optional features of the disclosure are indicated in the dependent claims.

DESCRIPTION OF THE EMBODIMENTS

It will be appreciated that the term underpressure is analogous to (partial) vacuum pressure and/or a negative pressure, specifically with respect to the ambient pressure. In an embodiment, the method further comprises the steps of:

- measuring the position and/or orientation of the transport belt, wherein the measured position and/or orientation of the transport belt determines the position of each strip with respect to the respective support beam over which it extends;
- comparing to the measured position and/or orientation to a first reference;
- if the measured position and/or orientation deviates from the first reference, determining an adjustment of the transport belt to align the position and/or orientation to the reference without any of the strips uncovering a portion of their respective support beams.

To maintain alignment with the print station, the transport belt is constantly sensed and adjusted. For example, the position of the transport belt in the lateral direction perpendicular to the main transport direction X is detected. The orientation of the transport belt, e.g. the angle between one of its edges and the main transport direction as defined by the print station is further detected. The lateral position is compared to a lateral position reference and the orientation of the transport belt is compared to the main transport direction, which also acts as a first reference. In case of any deviation, an adjusting or corrective action is determined to re-align the transport belt with its respective one or more references. The adjusting or corrective action is however restricted, such that the transport belt is moved only, such that each strip remains fully covering the support beam below it. Thereby, the permeable are prevented from overlapping the support beams, such that ink cannot be deposited on the top surfaces of the support beams.

In an embodiment, substantially non-permeable is defined as liquid and preferably also air being unable to pass through the material of which the strip has been formed, unless the material has been modified to comprise at least one opening and/or through-hole. It will be appreciated that within the intended scope of substantially non-permeable, the strip may still be provided with one or a small number of openings and/or through-hole, so that these do not substantially change the permeability of the belt (e.g. less than 0.1% or even less than 0.01% change in permeability as compared to the material without openings). For example for other purposes than applying an underpressure to the sheet on the belt. Preferably, for the open areas the ratio of the combined surface area of the openings with respect to the (local) total surface of the open area (or the belt) is at least 0.1%, preferably at least 0.5%, and even more preferably is at least 1%.

For the strip to be substantially non-permeable the ratio of the combined surface area of the openings with respect to the (local) total surface of the strip (or the belt) is preferably less than 1%, more preferably less than 0.5%, and very preferably less than 0.1%. In another embodiment, the number of openings per unit area in the areas is at least 100 times, preferably at least 200 times, very preferably, at least 500 times greater than in the strips.

In an embodiment, the step of determining an adjustment comprises:

determining at least one parameter corresponding to a distance between a periphery of at least one a support beam and a periphery of the corresponding strip, and determining each adjustment of the transport belt, such that said at least one parameter is prevented from crossing a predetermined threshold, which threshold corresponds to the peripheries of the support beam and the corresponding strip overlapping.

When viewed perpendicular to a medium support plane of the transport belt, adjustment of the transport belt is controlled, such that each support beam is kept inside the edges of its respective, overlapping strip.

In an embodiment, a width of each strip is greater than that of the respective support beam and the step of controlling comprises rotating and/or shifting each strip with respect to its respective support beam, such that lateral edges of each support beam are always kept in between lateral edges of the respective strip without contact. The strips are wider in the lateral direction than the support beams. The width of the strips in the lateral direction is preferably at least 1.5 times, very preferably at least twice, and even more preferably at least 5 times the width of the top surface of the support beams. It will be appreciated that herein the width of the support beams refers to the width of the top surface of the support beams in contact with the transport belt. Additionally, the distance between openings in the belt is preferably small, so that the density of openings is large to ensure proper holding of a sheet regardless of its position, skew angle, size, and/or material. Preferably, the distance between openings is as small as what can be achieved by the applied manufacturing method, which may comprise punching or (laser) drilling of the belt to form the openings.

In an embodiment, the method further comprises the step of determining the positions and orientations of the support beams and storing a second reference based on the determined positions and orientations of the support beams. The controller's memory further stores the information regarding the geometrical positioning of the support beams with respect to the print station. In the second reference the positions and lateral widths of the top surfaces of the support beams are defined in a suitable format. By combining the position information generated by detecting position and/or orientation of the transport belt, e.g. by means of the markers, with pre-determined positional information corresponding the relatively positioning of the strips with respect to the markers, the current positions of the strips with respect to the print station and/or the support beams can be determined. By applying the first reference, it is further determined whether adjustment of the transport belt's position is required. That information is then compared to the second reference to determine the relative positioning of the strips on the transport belt with respect to the corresponding support beams. By constantly updating this information the strips can be controlled to be in constant and full overlap with the support beams.

In an embodiment, the method further comprises the step of determining positions and/or orientations of the strips with respect to markers on the transport belt and storing information corresponding to said determined positions and/or orientations on a memory of a controller. The positional data from the markers is transmitted to the controller, which compares said data to a look-up table storing the relative positions of each strip with respect to the markers. Thus the controller obtains the current positions of all strips for comparison to the second reference, which defines the positions of the support beams.

In an embodiment, the method further comprises the step of sensing the markers for generating data. The method further comprises the steps of comparing said data to a first reference to determine whether an adjustment of the position and/or orientation of the belt is required. From the markers, the current position and/or orientation of the belt with respect to the print station is determined. In case, it is found that the belt is no aligned with the print station, the controller is programmed to determine a re-positioning of the belt and to execute it. Therein, the controller is applying the positional information to said data to control that any adjustment is executed, such that top surfaces of the support beams remain free from the permeable areas. The positional information allows the controller to derive from the data the positions of the strips with respect to the support beams. The positional information allows the controller to determine the position of the strips with respect to the markers, and thus with respect to the print station. The second reference comprises information about the positions of the support beams with respect to the print station. By comparing the determined positions of the strips to the second reference, the controller can determine the relative positions of each strip with respect to its support beam. This strip-to-support beam position information is applied in determining the corrective adjustment of the belt. When determining a corrective adjustment of the belt, any potential movements of the belt that would position the permeable areas at least partially over the top surface of any support beam are excluded from the final single or series of corrective movements, which are applied to re-align the belt with the print station.

In an embodiment, a ratio of a combined surface area of the openings with respect to a surface area of the belt is less than 50%, preferably less than 40%, more preferably less than 30%, even more preferably between 1% and 20%, and very preferably between 1% and 10%. The pattern of the openings is preferably relatively fine: diameters of the openings are small and the openings themselves are positioned in relatively close proximity, preferably as small and/or as close as the manufacturing method will realistically allow. This ensures reliable holding of the sheets on the belt.

In an embodiment, a ratio of a width of at least one strip in a lateral direction of the belt with respect to a width of at least one area is less than 40%, preferably less than 35%, very preferably less than 30%, even more preferably less than 30%, and especially preferably less than 25%. The support beams and/or the strips are preferably small to ensure reliable holding of the sheet by means of the applied negative pressure.

The disclosure further relates to a printer comprising:

an endless transport belt supported on a plurality of support beams to define a medium support plane opposite an inkjet printhead assembly, wherein the transport belt comprises a plurality of spaced apart, endless, substantially non-permeable strips between areas with openings, through which openings an underpressure is applicable to a print medium of the transport belt by means of a suction device;

a sensor assembly for detecting a position and/or orientation of the transport belt with respect to the printhead assembly;

a controller configured to control the transport belt to a given range so that the substantially non-permeable strips do not deviate from the support beams as a result.

In an embodiment, the controller is configured for receiving and/or storing position information of the support beams and the printhead assembly and is configured for comparing the detected position and/or orientation of the transport belt to said information and for adjusting the position and/or orientation of the transport belt based thereon, such that each strip is maintained to entirely cover the respective support beam over which it extends.

The transport belt is supported on a plurality of support beams, which are in a fixed position with respect to the print station. The print station defines a main transport direction perpendicular to the rows of nozzles on the printheads. The transport belt is initially positioned, such that its strips fully cover the top surfaces of the support beams. The permeable areas are positioned between the top surfaces of the support beams, when viewed perpendicular to the medium support plane. The sensor assembly is further fixed with respect to the print station. By detecting the position and/or orientation of the transport belt, the current positions of each of the strips with respect to the support beams is determined. Preferably, the controller comprises a memory storing positional information of the strips relative to markers on the transport belt, which markers are sensed for determining the position and/or orientation of the belt. The controller further compares the detected position and/or orientation of the transport belt to a predefined first reference, which preferably corresponds to the main transport direction and/or position of the print station to determine whether a positional adjustment of the transport belt is required. If so, then the transport belt is controlled to shift and/or re-orient itself while keeping the strips over the support beams. The markers are constantly detected during this process allowing for an accurate re-positioning of the transport belt and the strips. Since the non-permeable strips cover the support beams during the printing process, ink droplets are prevented from being deposited on the top surface of the support beams. Thereby, the interface between the transport belt and the support beams remains free from ink contamination, which would otherwise change the frictional interaction between the two, resulting in reduced accuracy of the transport belt's positioning.

The disclosure further relates to a computer program comprising instructions to cause the printer as described above to execute the steps of the above described method of printing. The computer program may be provided on a suitable computer-readable (storage) medium to carry out the method on the printer. Alternatively, the printer may comprise a data processing apparatus comprising a processor configured to perform the steps of the above described method on a printer.

Further scope of applicability of the present disclosure will become apparent from the detailed description given hereinafter. However, it should be understood that the detailed description and specific examples, while indicating embodiments of the present disclosure, are given by way of illustration only, since various changes and modifications within the spirit and scope of the present disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure, and wherein.

DETAILED DESCRIPTION OF THE EMBODIMENTS

Figure 1:
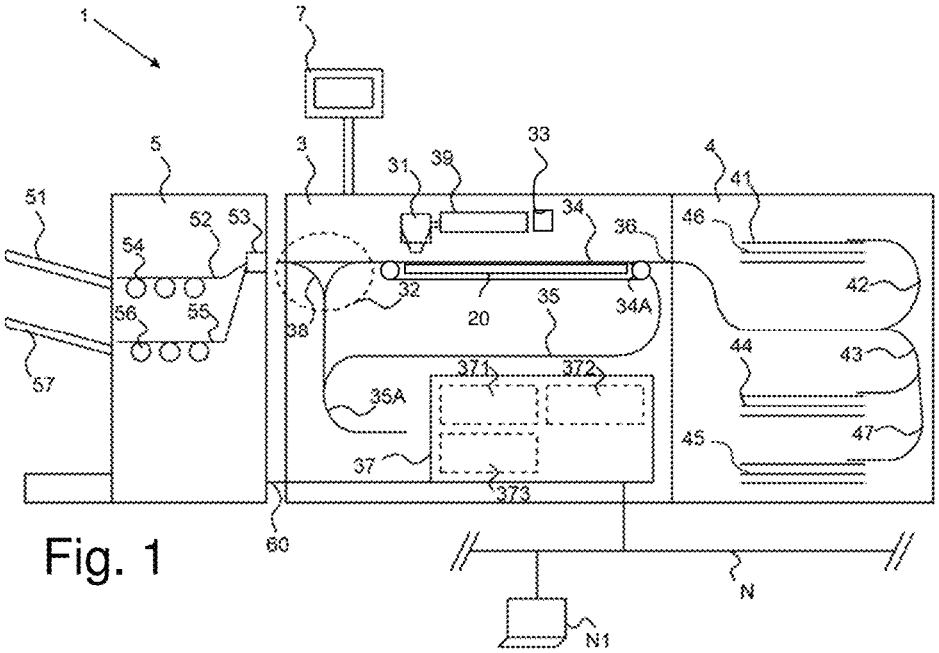
FIG. 1 is a schematic side view of a sheet printer.

The present disclosure will now be described with reference to the accompanying drawings, wherein the same reference numerals have been used to identify the same or similar elements throughout the several views.

FIG. 1 shows schematically an embodiment of a printing system 1 according to the present disclosure. The printing system 1, for purposes of explanation, is divided into an output section 5, a print engine and control section 3, a local user interface 7 and an input section 4. While a specific printing system is shown and described, the disclosed embodiments may be used with other types of printing system such as an ink jet print system, an electrographic print system, etc.

The output section 5 comprises a first output holder 52 for holding printed image receiving material, for example a plurality of sheets. The output section 5 may comprise a second output holder 55. While 2 output holders are illustrated in FIG. 1, the number of output holders may include one, two, three or more output holders. The printed image receiving material is transported from the print engine and control section 3 via an inlet 53 to the output section 5. When a stack ejection command is invoked by the controller 37 for the first output holder 52, first guiding means 54 are activated in order to eject the plurality of sheets in the first output holder 52 outwards to a first external output holder 51. When a stack ejection command is invoked by the controller 37 for the second output holder 55, second guiding means 56 are activated in order to eject the plurality of sheets in the second output holder 55 outwards to a second external output holder 57.

The output section 5 is digitally connected by means of a cable 60 to the print engine and control section 3 for bi-directional data signal transfer.

The print engine and control section 3 comprises a print engine and a controller 37 for controlling the printing process and scheduling the plurality of sheets in a printing order before they are separated from input holder 44, 45, 46.

The controller 37 is a computer, a server or a workstation, connected to the print engine and connected to the digital environment of the printing system, for example a network N for transmitting a submitted print job to the printing system 1. In FIG. 1 the controller 37 is positioned inside the print engine and control section 3, but the controller 37 may also be at least partially positioned outside the print engine and control section 3 in connection with the network N in a workstation N1.

The controller 37 comprises a print job receiving section 371 permitting a user to submit a print job to the printing system 1, the print job comprising image data to be printed and a plurality of print job settings. The controller 37 comprises a print job queue section 372 comprising a print job queue for print jobs submitted to the printing system 1 and scheduled to be printed. The controller 37 comprises a sheet scheduling section 373 for determining for each of the plurality of sheets of the print jobs in the print job queue an entrance time in the paper path of the print engine and control section 3, especially an entrance time for the first pass and an entrance time for the second pass in the loop in the paper path according to the present disclosure. The sheet scheduling section 373 will also be called scheduler 373 hereinafter.

The sheet scheduling section 373 takes the length of the loop into account. The length of the loop corresponds to a loop time duration of a sheet going through the loop dependent on the velocity of the sheets in the loop. The loop time duration may vary per kind of sheet, i.e. a sheet with different media properties.

Resources may be recording material located in the input section 4, marking material located in a reservoir 39 near or in the print head or print station 31 of the print engine, or finishing material located near the print head or print station 31 of the print engine or located in the output section 5 (not shown).

The paper path comprises a plurality of paper path sections 32, 31, 34, 35 for transporting the image receiving material from an entry point 36 of the print engine and control section 3 along the print head or print station 31 to the inlet 53 of the output section 5. The paper path sections 32, 31, 34, 35 form a loop according to the present disclosure. The loop enables the printing of a duplex print job and/or a mix-plex job, i.e. a print job comprising a mix of sheets intended to be printed partially in a simplex mode and partially in a duplex mode.

The print head or print station 31 is suitable for ejecting and/or fixing marking material to image receiving material. The print head or print station 31 is positioned near the paper path section 34. The print head or print station 31 may be an inkjet print head, a direct imaging toner assembly or an indirect imaging toner assembly.

While an image receiving material is transported along the paper path section 34 in a first pass in the loop, the image receiving material receives the marking material through the print head or print station 31. A next paper path section 32 is a flip unit 32 for selecting a different subsequent paper path for simplex or duplex printing of the image receiving material. The flip unit 32 may be also used to flip a sheet of image receiving material after printing in simplex mode before the sheet leaves the print engine and control section 3 via a curved section 38 of the flip unit 32 and via the inlet 53 to the output section 5. The curved section 38 of the flip unit 32 may not be present and the turning of a simplex page has to be done via another paper path section 35.

In case of duplex printing on a sheet or when the curved section 38 is not present, the sheet is transported along the loop via paper path section 35A in order to turn the sheet for enabling printing on the other side of the sheet. The sheet is transported along the paper path section 35 until it reaches a merging point 34A at which sheets entering the paper path section 34 from the entry point 36 interweave with the sheets coming from the paper path section 35. The sheets entering the paper path section 34 from the entry point 36 are starting their first pass along the print head or print station 31 in the loop. The sheets coming from the paper path section 35 are starting their second pass along the print head or print station 31 in the loop. When a sheet has passed the print head or print station 31 for the second time in the second pass, the sheet is transported to the inlet 53 of the output section 5.

The input section 4 may comprise at least one input holder 44, 45, 46 for holding the image receiving material before transporting the sheets of image receiving material to the print engine and control section 3. Sheets of image receiving material are separated from the input holders 44, 45, 46 and guided from the input holders 44, 45, 46 by guiding means 42, 43, 47 to an outlet 36 for entrance in the print engine and control section 3. Each input holder 44, 45, 46 may be used for holding a different kind of image receiving material, i.e. sheets having different media properties. While 3 input holders are illustrated in FIG. 1, the number of input holders may include one, two, three or more input holders.

The local user interface 7 is suitable for displaying user interface windows for controlling the print job queue residing in the controller 37. In another embodiment a computer N1 in the network N has a user interface for displaying and controlling the print job queue of the printing system 1.

Figure 2:
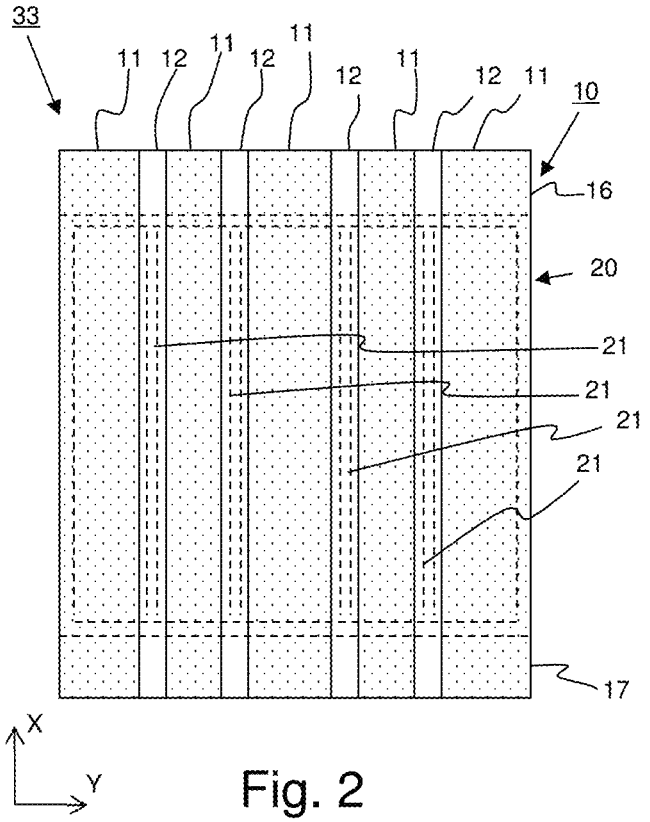
FIG. 2 is an enlarged, schematic top-down view of the transport belt assembly of the printer in FIG. 1.
Figure 3:
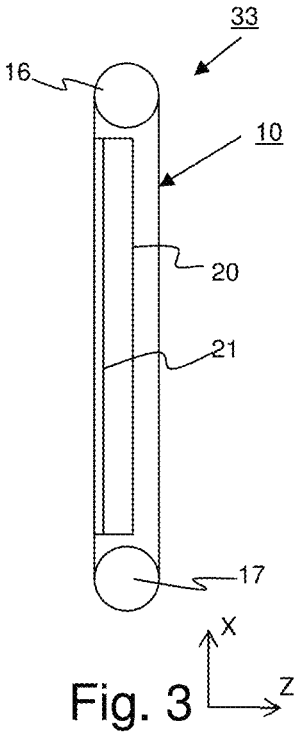
FIG. 3 is a schematic side view of the transport belt assembly in FIG. 2.

FIGS. 2 and 3 show the paper path section 34, which comprises an endless transport belt 10. The transport belt 10 is supported on two or more rollers 16, 17. The rollers 16, 17 are spaced apart from one another in the main transport direction X. At least one of the rollers 16, 17 comprises a drive (not shown) for rotating the roller 16, 17 and thereby driving the transport belt 10. The angle and/or orientation of at least one roller 16, 17 can further be adjusted by means of an actuator (not shown) to change the position and/or orientation of the transport belt. The transport belt 10 is air permeable in the predetermined areas 11. The areas 11 are provided with openings or through-holes that allow gas to pass through the respective portion of the transport belt 10. The areas 10 extend as endless loops partially along the main transport direction X and are separated from one another by non-permeable strips 12. The strips 12 are closed or sealed sections of the transport belt 10, where liquid and preferably also gas cannot pass through. The areas 11 may for example be formed by perforating the respective sections of a sheet of a single material, such as plastic, metal, rubber, etc., while the strips 12 are formed by non-perforated sections. The strips 12 are endless and spaced apart from one another in the lateral direction Y of the transport belt 10. The orientation of the belt 10 is herein defined preferably its angle with respect to the main transport direction X. The current orientation of the belt 10 may be derived from a suitable line along the periphery of the belt 10, such as a line, a row of markers, or one of its edges.

Between the rollers 16, 17 the transport belt 10 is supported on the support beams 21 of the suction device 20. The suction device 20 comprises a chamber with an open side facing the inner surface of the transport belt 10. The belt 10 covers the open side of the chamber. By means of a suction source, such as a pump or fan, a negative pressure or underpressure may be applied in the chamber, such that ambient air may be drawn into the chamber via the permeable areas 11 of the transport belt 10. Thereby, a print medium can be releasably fixed to the transport belt 10, such that is transported by the transport belt 10 along the print station 31 facing the transport belt 10. The support beams 21 extend substantially in the main transport direction X over or across the chamber of the suction device 20. The support beams 21 prevent the transport belt 10 from being sucked into the chamber by the negative pressure, but are spaced apart from one another in the lateral Y to allow air to pass through. Prior to printing, the transport belt 10 is positioned such that the strips 10 fully overlap the support beams 21. The permeable areas 11 are entirely in between the top surfaces of the support beams 21. When viewed in the vertical direction Z (which is perpendicular to the main transport and lateral direction X, Y during use), the permeable areas 11 are positioned besides the support beams 21.

Figure 4:
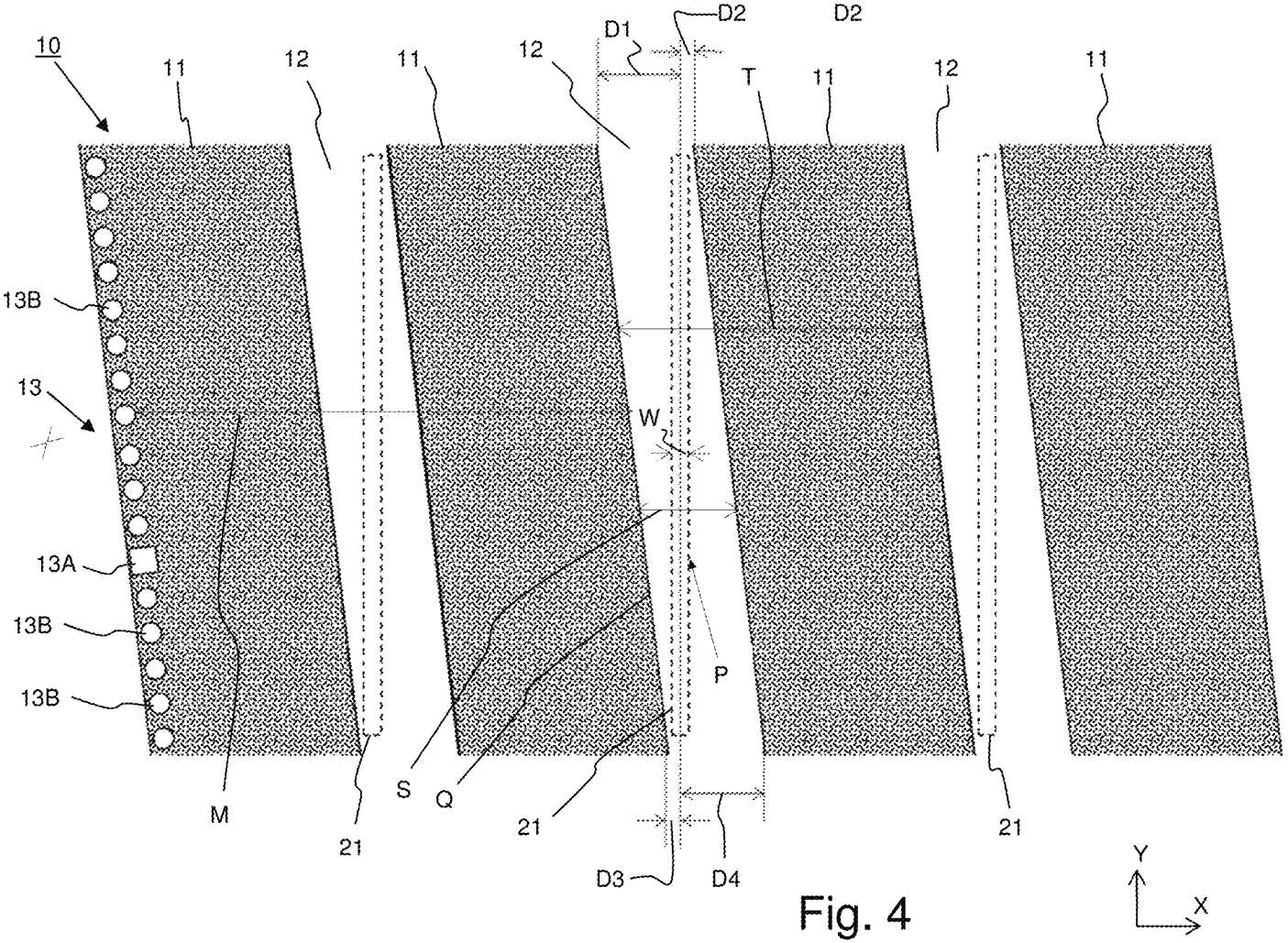
FIG. 4 is a schematic top-down view of a transport belt assembly as in FIG. 2 in a mis-oriented state.

FIG. 4 shows the transport belt 10 in a top down view. It is shown that transport belt 10 is further provided with markers 13 along its circumference. The markers 13 are detectable by means of a sensor assembly 33 positioned over the transport belt 10. The markers 13 are preferably detected at two different positions in the main transport direction X. Each marker 13 is further uniquely identifiable. In FIG. 4, a starting marker 13A is configured, colored, marked, and/or shaped differently from the regular markers 13B. The regular markers 13B are configured similarly. The starting marker 13A is identified by its distinguishing features and each regular marker 13B can be uniquely identified by counting the number of markers 13B following the detection of the starting marker 13A.

The sensor assembly 33 detects the markers 13 at a predetermined position and transmits the information regarding the detected positions and detection times to the controller 37. The controller 37 further stores transport belt marker information, such as the number of markers 13 and their respective positions on the transport belt 10. By counting the markers 13 and comparing the received information to the transport belt marker information, the controller 37 can determine the speed, lateral position, and orientation (i.e. skew angle) of the transport belt 10. By tracking or counting the markers 13 from the starting marker 13A, the controller 37 can identify which segment of the transport belt 10 is currently at the sensor assembly 33 and/or the print station 31.

The controller 37 stores a first reference, corresponding to the print station's position and/or orientation. The position and/or orientation of the belt 10 as derived from the markers 13 is compared to the first reference. For example, the current angle of the row of markers 13 in the medium support plane with respect to the main transport direction X may be determined, to check whether an adjustment of the orientation of the belt 10 is required. Similarly, the controller 37 may determine whether the belt 10 is at the intended lateral position to determine whether a lateral shift of the belt 10 is required.

The controller 37 further stores positional information that relates the positions of the markers 13 to the positions of the strips 12 on the belt 10. Thus, when detecting the markers 13, the controller 37 can apply this positional information to determine the current positions of portions of the strips 12 that are presently over the support beams 21. Thereby, the controller 37 is able to constantly determine the positions of the portions of the strips 12 in the medium support plane. Additionally, the controller 37 stores a second reference, that defines the positions the support beams 21. By comparison, the controller 37 can thus determine the position of each strip 12 with respect to its respective support beam 21. It will be appreciated that these comparison may be also performed within a single algorithm using any suitable set of parameters to relate the strips 12 to the support beams 21.

Figure 5:
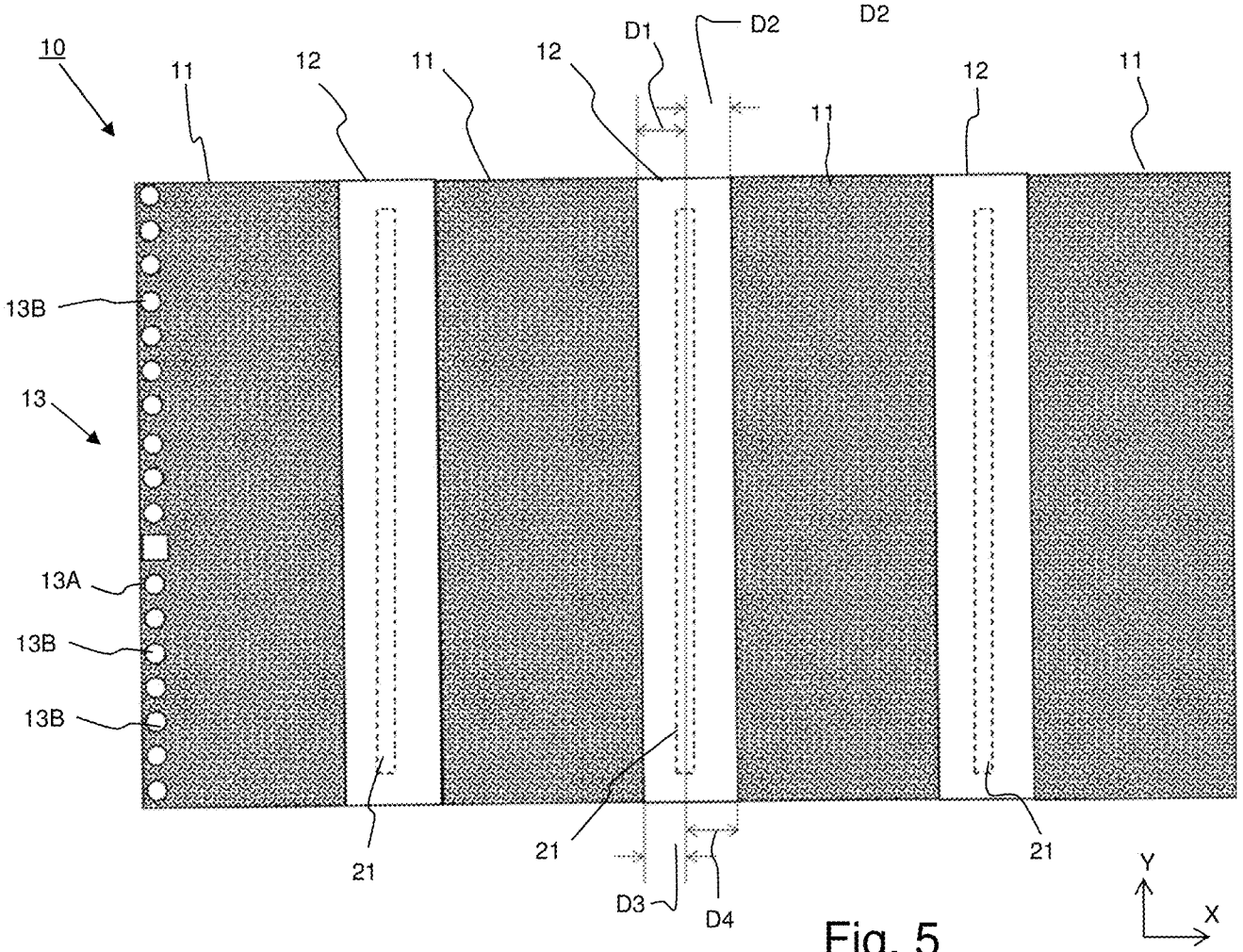
FIG. 5 is a schematic top-down view of the transport belt assembly in FIG. 4 in after realignment.

FIG. 4 illustrates the transport belt 10 in a rotated state with respect to its starting orientation as shown in FIG. 5. The edges of the transport belt 10 as well as the row of markers 13 in the medium support plane are not parallel to the main transport direction X. In the example of FIG. 4, the support beams 21 are parallel to the main transport direction X and positioned equidistant from one another. The strips 12 and the permeable areas 11 are also dimensioned identically and positioned at consistent intervals, with the possible exception of the lateral edges of the transport belt 10.

The sensor assembly 33 detects the markers 13 and, based on that, the controller 37 determines whether the orientation the transport belt 10, specifically of the segment of the transport belt 10 currently facing the print station 31, deviates from the intended orientation, in this case the main transport direction X. Similarly, the lateral position of the transport belt 10 is compared to that of the print station, such that the image may be printed in the intended lateral position on the print medium. The main transport direction X is perpendicular to the nozzle rows of the printheads in the print station 31, while the outer left or right nozzle of the print station 31 determines the reference for the lateral position. When the transport belt 10 is skewed with respect to the main transport direction X, the image will printed misaligned on the print medium with respect to the edges of the print medium. The controller 37 then applies an orientation adjustment by adjusting the position and/or angle of one or more of the rollers 16, 17 using one or more actuators provided at the rollers 16, 17. Thereby, the transport belt 10 is re-oriented to the transport direction X, as shown in FIG. 5. Prior to and/or during the re-orientation process the controller 37 ensures that the support beams 21 do not come into contact with the permeable areas 11. Thereby, the controller 37 follows the steps indicated in FIG. 7.

In step i, the first reference is determined by the positioning of the print station 31. The print station determines the main transport direction X with respect to the frame of the printer 1. Similarly, it determines the lateral position of the printable area, which defines a lateral position reference.

Figure 7:
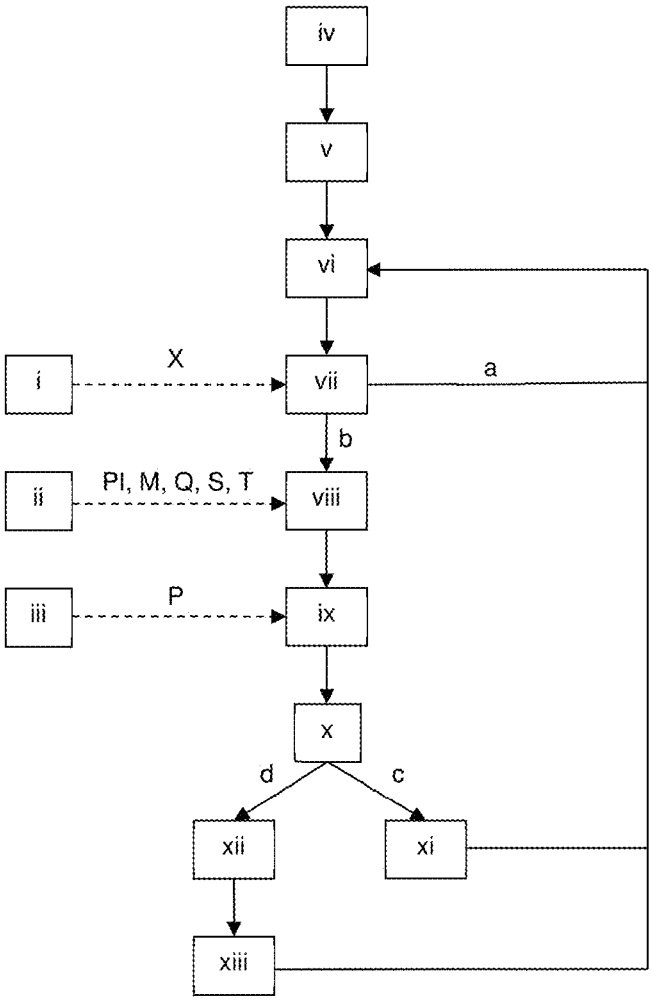
FIG. 7 is a block diagram illustrating the steps of a method for printing on a printer as in FIG. 1.

In step ii in FIG. 7, the positions of the support beams 21 are determined. The positions of the support beams 21 are determined from predetermined specifications of the printer or measured after assembly. The positions are relative to a reference point fixed with respect to the stationary frame of the printer, which frame rigidly supports the print station 31, the suction device 20, and the actuators and/or bearings for the rollers 16, 17. The position of each support beam 21 and its dimensions are input to the memory of the controller 37 in a suitable format. In the example of FIG. 4, at least the width W and lateral position P of one of the support beams 21 is stored, while the positions of the other support beams 21 may be derived by further storing the spacing distance S between them as well as their number. The information for defining the positions P and width W of the support beams 21 may be stored in any other suitable form as well. The positions of the support beams 21 are determined with respect to the first reference.

Step iii comprises determining positional information PI that relates the positions Q of the strips 12 to the positions of the markers 13. The positional information includes data corresponding to the positions Q of the strips to that of markers 13, expressed as the marker-to-strip distance M in FIG. 4. In the example of FIG. 4, the positions of the other strips van be derived from the inter-strip-spacing distance T, the strip width S, and the position Q of at least one strip 12. The controller 37 stores said positional information PI, S, Q. The controller 37 further stores positional information of the markers 13, for example the spacing between the markers 13 and their total number. By identifying the starting marker 13A by its deviating configuration, the controller 37 can count the number of regular markers 13B passing the sensor assembly 33 since the passage of the starting marker 13A. From the counted number, each regular marker 13B can be uniquely identified, allowing the controller 37 to determine the respective section of the transport belt 10 facing the print station 31. For each marker 13, the controller 13 is able to determine the relative position and/or width of each strip 12 at the respective position in the main transport direction X. The strips 12 in the example of FIG. 4 are further all parallel to the row of markers 13. The strips 12 are further equidistant with spacing T and have the same width W. In this simplified example, maintaining a single strip 12 in full overlap with its respective support beam 21 will ensure all strips maintain in total coverage of their respective support beams 21.

In step iv, the transport belt 10 is mounted on the rollers 16, 17, such that the strips 12 are aligned with the support beams 21. Before printing is started, the strips 12 are positioned, such that these entirely overlap the support beams 21.

The printing process is then started in step v by the driving the transport belt 10 and applying a negative pressure on a print medium on the transport belt 10 via the suction device 20. Thereby, print media may be moved along the print station 31 to form an image on said print media. The transport belt 10 is preferably in continuous motion, but step-wise transport of the print medium may be applied as well.

In step vi, the markers 13 on the belt 10 are detected by the sensor assembly 33. From the generated data, the controller 37 determines the speed, lateral position, and orientation of the belt 10 with respect to the main transport direction X. As explained above, this comprises detecting the markers 13 and then deriving the lateral position and/or orientation of the transport belt 10. Since the markers 13 are uniquely identifiable the controller 37 further determines which portion of the transport belt 10 is currently moving over the support beams 21.

In step vii, the position and/or orientation of the transport belt 10 are compared to the first reference to determine whether the belt 10 is parallel to the main transport direction X and/or at the aligned lateral position with respect to the print station 33. The lateral position and/or orientation of the transport belt 10 are compared to predetermined one or more first references in step vii. These references correspond to the positions of the printheads of the print station 31, which during use are in fixed position with respect to the support beams 21. In this example, one reference is the main transport direction X and another reference is the starting lateral position of the transport belt 10. Other suitable references may be applied. From this comparison the controller 37 determines whether a positional adjustment of the belt 10 is required.

In case the controller 37 determines that the belt 10 is aligned with the main transport direction X and at the starting lateral position, the controller 37 resumes step vi to keep monitoring the belt 10 (path a in FIG. 7).

In case, the controller 37 determines that the position and/or orientation of the belt 10 deviate from the first reference(s), the controller 37 proceeds to determine a positional adjustment of the belt 10 (path b in FIG. 7).

When the controller 37 determines that the determined position and/or orientation of the transport belt 10 deviate from their respective references, the controller 37 proceeds to determine a corrective action for re-aligning the transport belt 10 back to onto its references. The corrective action involves adjusting the relative orientations of the rollers 16, 17, such that the transport belt 10 is returned to its starting position. By rotating the rollers 16, 17, the transport belt 10 is shifted and re-oriented, but within the restriction that the strips 12 remain in full overlap with the support beams 21.

In the example, in FIG. 4, in step viii the controller 37 determines the positions of four points on one of the strips 12. The position of points on the one strip 12 is derived from the position and orientations determined from the markers 13 using the positional information PI, M, Q, S, T. The relative position of the strip 12 with respect to each marker 13 was determined in a prior measurement and stored in the memory of the controller 37 in step ii. The points are selected to have the same position in the main transport direction X, as the corners of the support beam 21 below the respective strip 12.

The position P of the respective support beam 21 was also stored in the controller's memory in step iii. The controller 37 in step ix compares the position of the support beam 21 to the position and/or orientation of the strip 12. The controller 37 therein determines the lateral distances D1-D4 between the respective corners of the support beam 21 and the adjacent points on the strip 12.

In step x, the controller 37 proceeds to determine the adjustment required for returning the belt 10 to its initial state as in FIG. 5. In step x, the controller 37 determines the manner of executing the positional adjustment. The controller 37 in the example of FIG. 7 checks whether the required positional adjustment, e.g. the rotation and/or shift of the belt 10, can be executed in a single step without causing the permeable areas 11 to shift over the support beams 21. The controller 37 compares each lateral distance D1-D4 to the half width W/2 of the support beam 21. The corrective action is to be executed, such that each lateral distance D1-D4 does not equal or is smaller than the half width W/2. The information regarding the half width W/2 has been stored on the memory of the controller 37 prior to starting the printing process. In case, the corrective, positional adjustment can be performed in a single step without exposing the support beams 21, the controller 37 proceeds to perform said single rotation or shift in step xi (path c). The controller 37 then returns to step vi, repeating the above process.

In case that the controller 37 determines that the re-orientation of the belt 10 cannot be performed in a single step, an algorithm is applied in step xii, the divide the adjustment in a series of alternating lateral shifts and re-orientations or rotations of the transport belt 10 to ensure that in each corrective sub-step the permeable areas 11 do not move over the support beams 21. These sub-steps are performed in step xiii, thereby bringing the belt 10 back to the state in FIG. 5. The controller 37 then returns to step vi, repeating the above process at least until completion of the print job.

In the example of FIG. 4, the controller 37 has determined that transport belt 10 and thus the strips 12 are misaligned with respect to the main transport direction X. As two opposite lateral distances D2, D3 are close to the half width W/2, the controller 37 first performs a rotation around the center of the transport belt 10. The rotation increases the smaller, lateral distances D2, D3 and decreases the other distances D1, D4 until all lateral distances D1-D4 are roughly similarly in size. If required, the controller 37 may then apply a lateral shift of the transport belt 10 to align the center of the strip 12 with that of its respective support beam 21. Lateral shifting may be achieved by consecutive small re-orientations of the transport belt 10 wherein the strip 12 is oriented away from or non-parallel to the main transport direction X, while ensuring that the lateral distances D1-D4 do not go below the half width W/2. In the example of FIG. 4, all strips 12 and support beams 21 are respectively equidistant and respectively possess the same dimensions. After the corrective action has been completed the transport belt 10 is aligned such that its strips 12 are parallel to the main transport direction X and the transport belt 10 is back at its lateral starting position, as shown in FIG. 5.

Figure 6:
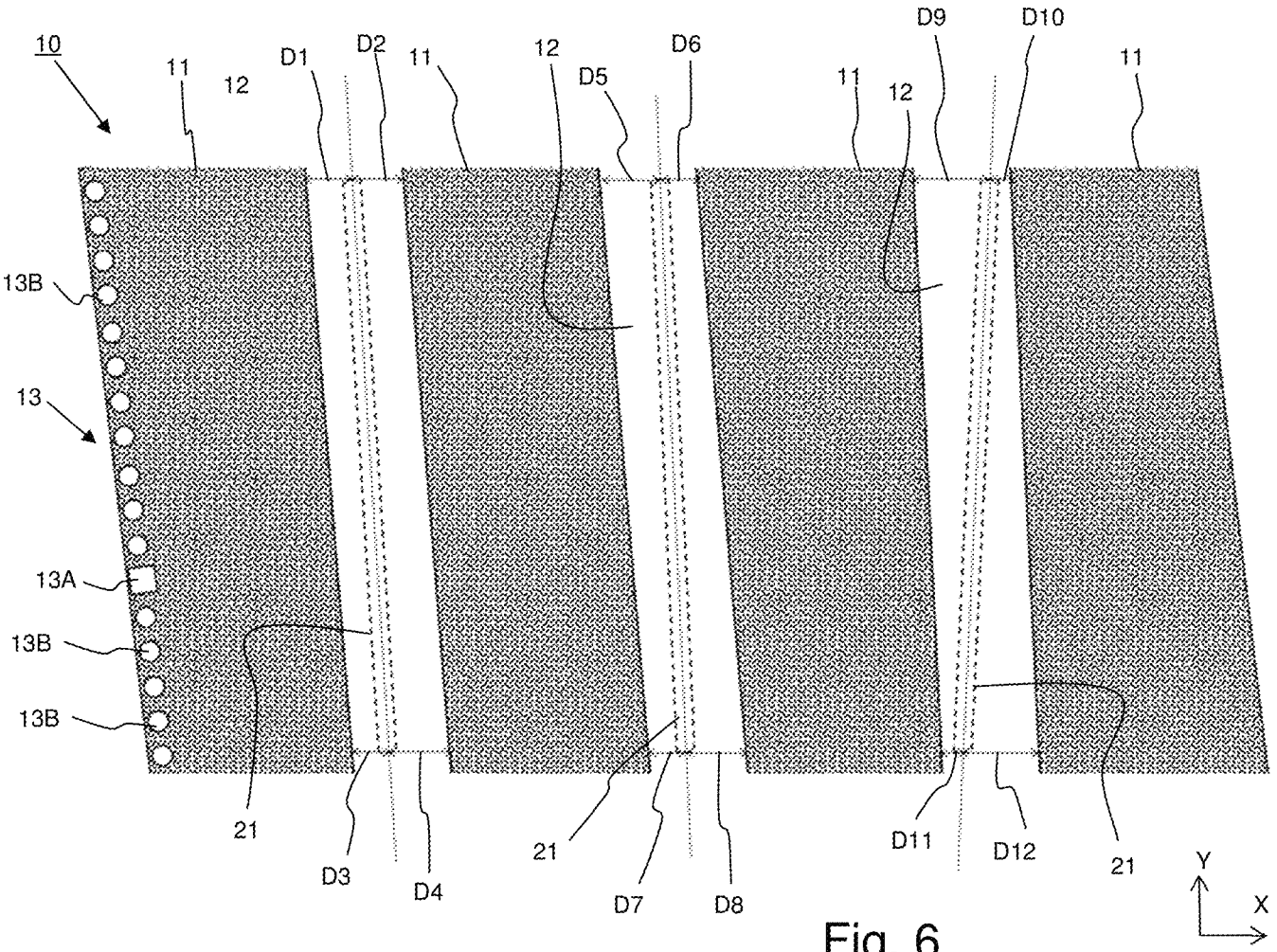
FIG. 6 is a schematic top-down view of another transport belt assembly as in FIG. 2 in another mis-oriented state.

FIG. 6 illustrates a more complicated example wherein the support beams 21 and the strips 12 are not in respective alignment due to deviations in the manufacturing processes. The process is similar to that described for FIG. 4. The controller 37 determines the orientation and position of the transport belt 10 from the sensed markers 13. Based on that the position and orientation of four points on each individual strip 12 are determined based on pre-stored dimensional information of each strip 12 with respect to the markers 13. That information is compared to pre-stored information regarding the position and dimensions of the respective support beams 21 to derive the lateral distances D1-D12 for four points, similar to FIG. 4, but for each strip 12 individually. The corrective action is determined under the restriction that none of the lateral widths D1-D12 will become equal and/or smaller than the respective half width of the corresponding support beam 21. The controller 37 will thus perform one or more re-orientations and/or lateral shifts to re-align the markers 13 to the main transport direction X and to position the markers 13 at their reference lateral position.

The above process is repeated continuously during printing. The jetting of the printheads results in a fine mist of droplets building up between the transport belt 10 and the print station 31 over time. Mist droplets are sucked into the suction device 20 via uncovered, air permeable areas of the transport belt 10 and deposit themselves on the inner surfaces of the suction device 20. Because the controller 37 maintains the non-permeable strips over the support beams 21 mist droplets are prevented from adhering to the top surfaces of the support beams 21, which top surfaces are in contact with the transport belt 10. This prevents changes in the frictional contact between the transport belt 10 and the support beam 21. This allows for continued accurate control of the transport belt's position over longer periods, as the frictional forces involved do not change over time. Ink deposition between the transport belt 10 and the support beams 21 would otherwise alter the frictional interaction between the transport belt 10 and the support beams 21, such that the steering actions would no longer result in the intended positional corrections. Also, wear on the transport belt 10 is reduced, as direct contact with ink material is avoided, thereby improving the lifetime of the transport belt 10.

Figure 8:
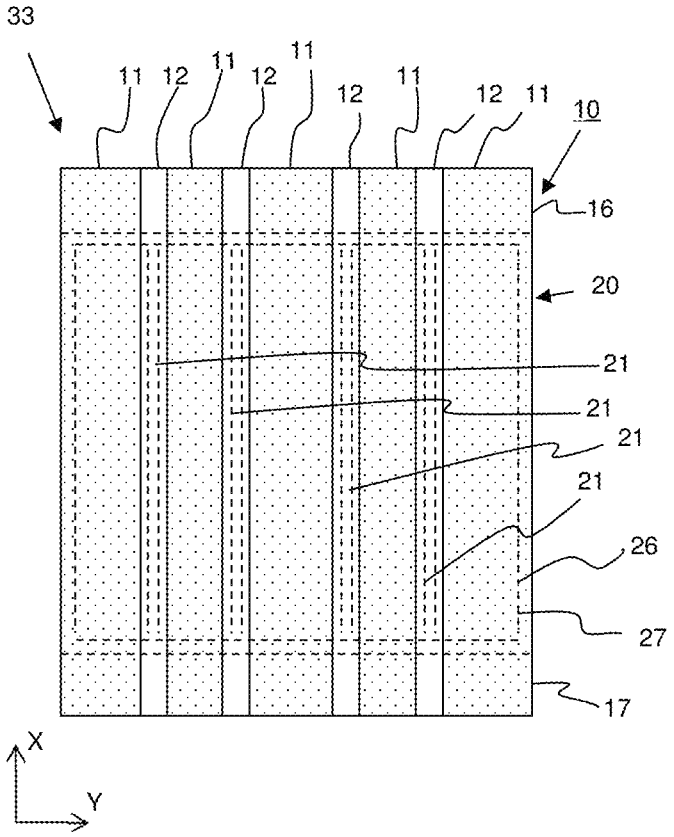
FIG. 8 is an enlarged, schematic top-down view of the transport belt assembly of the printer in FIG. 1 comprising a detection system.
Figure 9:
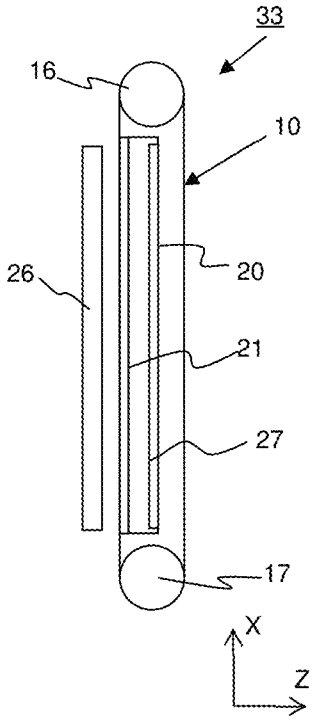
FIG. 9 is a schematic side view of the transport belt assembly in FIG. 8.

FIGS. 8 and 9 illustrate an embodiment of the printer, wherein a detection system is provided for sensing and determining the positions and orientations of the strips 12 with respect to their support beams 21. The operation is similar to what was discussed above for FIGS. 2 to 7 with the exception that the position of a support beam 21 with respect to its corresponding strip 12 is detected directly instead of derived from the markers on the transport belt 10. The detection system may comprise an emitter 26, which may incorporated in the print station 31 or be mounted at the reservoir 39. The emitter 26 extends over the transport belt 10 facing the chamber of the suction device 20. The emitter 26 is configured to emit light or sound waver towards the belt 10. On an opposite side of the belt 10, a detector array 27 is provided in the chamber of the suction device 20. The detector array 27 faces the emitter 26, so that the belt 10 and the support beams 21 are positioned in between the emitter 26 and the detector array 27. The signal emitted by the emitter 26 is selected so that it travels at least partially through the belt 10 onto the detector array 27. Thereby, the position of the strips 12 and/or the support beams 21 can thereby by directly sensed. In a basic example, the detector array 27 comprises a array photo-sensors or a camera. The emitter 26 may be a light source, such as a laser. It will be appreciated that the emitter 26 is optional if a sufficiently sensitive detector 27 array is applied. The detector array 27 and the emitter 26 may further be provided at different positions, for example the detector array 27 may be positioned at the print station 31 or the reservoir 39. Control of the print belt 10 is preferably further similar to that describe for FIGS. 4 to 7.

Figure 10:
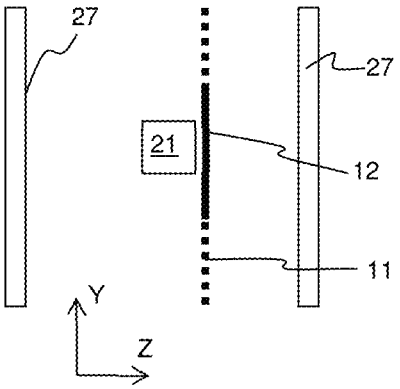
FIG. 10 is a schematic enlarged view of the transport belt assembly in FIG. 9.
Figure 11:
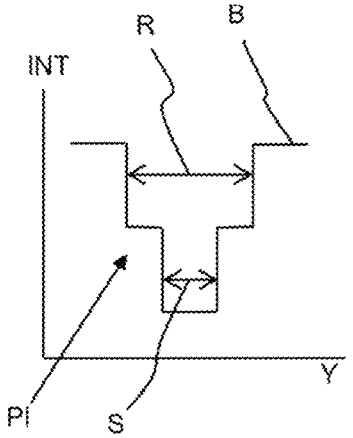
FIG. 11 is a schematic graph illustrating a signal for controlling the transport belt in FIGS. 8-10.

FIG. 10 illustrates an enlarged view of a support beam 21 and its corresponding strip 12 positioned in between the detector array 27 and the emitter 26. In this example, the emitter 26 is an optical emitter emitting light in the vertical direction Z. The light is transmitted through the belt 10. However, relatively more light is absorbed or blocked per surface area by the strips 12 than by the open areas 11. The support beam 21 is substantially non-permeable for the light. The detector array 27 extends in the lateral direction Y and receives different intensities of light dependent on the positions of the support beam 21, strip 12, and open area 11. The detector array 27 receives a signal which corresponds to the positional information PI. In this example, the positional information PI is visualized as data in the form of a graph in FIG. 11, wherein the intensity INT of received light is plotted against the lateral direction Y. On the outer edges, the signal is at its maximum received intensity corresponding to the permeable areas 11. The maximum received intensity is indicated as the baseline B. In the center, there is a range R, wherein the intensity is reduced with respect to the baseline B, since light is only partially transmitted through the strip 12. The range R corresponds substantially to the width of the strip 12 in the lateral direction Y. Within the range R, there is a further decrease in intensity corresponding to the position of the support beam 21. This drop in intensity is indicated as the signal S. When the position and/or orientation of the belt 10 requires adjustment, then the belt 10 is controlled such that the signal S remains inside the range R. The signal S is prevented from going beyond and/or outside the outer border of the range R. This ensures that the strip 12 remains over the support beam 21 at all times when adjusting the lateral position of the belt 10.

Although specific embodiments of the disclosure are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present disclosure being thus described, it will be obvious that the same may be varied in many ways. Such variations are not to be regarded as a departure from the spirit and scope of the present disclosure, and all such modifications as would be obvious to one skilled in the art are intended to be included within the scope of the following claims.

The invention claimed is:

1. A method of printing, comprising the steps of:

transporting a print medium along a print station for printing on the print medium by means of an endless, air permeable transport belt positioned over a suction device for applying an underpressure to the print medium on the transport belt, wherein the transport belt comprises endless, substantially non-permeable strips positioned between air permeable areas provided with openings and the suction device comprises a plurality of spaced apart support beams extending substantially in a main transport direction defined by the print station for supporting the transport belt; and controlling the position and/or orientation of the transport belt for aligning the print medium with respect to the print station, wherein each adjustment to the transport belt's position and/or orientation is restricted, such that the strips are maintained entirely overlapping the support beams.

2. The method according to claim 1, further comprising the steps of:

measuring the position and/or orientation of the transport belt, wherein the measured position and/or orientation of the transport belt determines the position of each strip with respect to the respective support beam over which it extends;

comparing to the measured position and/or orientation to a first reference; and if the measured position and/or orientation deviates from the first reference, determining an adjustment of the transport belt to align the position and/or orientation of the transport belt to the reference without any of the strips uncovering a portion of their respective support beams.

3. The method according to claim 2, wherein the step of determining an adjustment comprises:

determining at least one parameter corresponding to a distance between a periphery of at least one a support beam and a periphery of the corresponding strip, and determining each adjustment of the transport belt, such that said at least one parameter is prevented from crossing a predetermined threshold, which threshold corresponds to the peripheries of the support beam and the corresponding strip overlapping.

4. The method according to claim 1, wherein a width of each strip is greater than that of the respective support beam and the step of controlling comprises rotating and/or shifting each strip with respect to its respective support beam, such that lateral edges of each support beam are always kept in between lateral edges of the respective strip without contact.

5. The method according to claim 1, further comprising a step of determining the positions and orientations of the support beams and storing a second reference based on the determined positions and orientations of the support beams.

6. The method according to claim 5, further comprising a step of determining positions and/or orientations of the strips with respect to markers on the transport belt and storing information corresponding to said determined positions and/or orientations on a memory of a controller.

7. The method according to claim 6, further comprising the steps of:

sensing the markers for generating data;

comparing said data to a first reference to determine whether an adjustment of the position and/or orientation of the belt is required; and applying the positional information to said data to control that any adjustment is executed, such that top surfaces of the support beams remain free from the permeable areas.

8. The method according to claim 1, wherein a ratio of a combined surface area of the openings with respect to a surface area of the belt is less than 50%.

9. The method according to claim 8, wherein a ratio of a width of at least strip in a lateral direction of the belt with respect to a width of at least one area is less than 40%.

10. A printer comprising:

an endless transport belt supported on a plurality of support beams to define a medium support plane opposite an inkjet printhead assembly of a print station, wherein the transport belt comprises a plurality of spaced apart, endless, substantially non-permeable strips in between areas with openings, through which openings an underpressure is applicable to a print medium on the transport belt by means of a suction device;

a sensor assembly for detecting a position and/or orientation of the transport belt; and a controller configured to control the transport belt to a given range so that the substantially non-permeable strips do not deviate from the support beams as a result.

11. The printer according to claim 10, wherein the controller receives and/or stores position information of the support beams and the printhead assembly and which the controller is configured for comparing the detected position and/or orientation of the transport belt to said information and for adjusting the position and/or orientation of the transport belt based thereon, such that each strip is maintained to entirely cover the respective support beam over which it extends.

12. The printer according to claim 10, wherein a ratio of the combined surface area of the openings with respect to the belt's surface area is less than 50%.

13. The printer according to claim 12, wherein a ratio of a width of at least strip in a lateral direction of the belt with respect to a width of at least one area is less than 40%.

14. The printer according to claim 10, wherein the printer is configured to perform a method comprising the steps of:

transporting a print medium along the print station for printing on the print medium by means of the endless, air permeable transport belt positioned over the suction device for applying the underpressure to the print medium on the transport belt, wherein the transport belt comprises the endless, substantially non-permeable strips positioned between air permeable areas provided with openings and the suction device comprises a plurality of spaced apart support beams extending substantially in a main transport direction defined by the print station for supporting the transport belt; and controlling the position and/or orientation of the transport belt for aligning the print medium with respect to the print station, wherein each adjustment to the transport belt's position and/or orientation is restricted, such that the strips are maintained entirely overlapping the support beams.

15. The printer according to claim 10, wherein the controller is configured for controlling the position and/or orientation of the transport belt for aligning the print medium with respect to the print station, wherein each adjustment to the transport belt's position and/or orientation is restricted, such that the strips are maintained entirely overlapping the support beams.

16. A computer-readable storage medium storing a computer program comprising instructions, which when executed by a computer, causes a printer to execute steps of a method, wherein the printer includes:

an endless transport belt supported on a plurality of support beams to define a medium support plane opposite an inkjet printhead assembly of a print station, wherein the transport belt comprises a plurality of spaced apart, endless, substantially non-permeable strips in between areas with openings, through which openings an underpressure is applicable to a print medium on the transport belt by means of a suction device;

a sensor assembly for detecting a position and/or orientation of the transport belt; and a controller configured to control the transport belt to a given range so that the substantially non-permeable strips do not deviate from the support beams as a result, and wherein the method includes the steps of:

transporting a print medium along the print station for printing on the print medium by means of the endless, air permeable transport belt positioned over the suction device for applying an underpressure to the print medium on the transport belt, wherein the transport belt comprises the endless, substantially non-permeable strips positioned between the air permeable areas provided with openings and the suction device comprises a plurality of spaced apart support beams extending substantially in a main transport direction defined by the print station for supporting the transport belt; and controlling the position and/or orientation of the transport belt for aligning the print medium with respect to the print station, wherein each adjustment to the transport belt's position and/or orientation is restricted, such that the strips are maintained entirely overlapping the support beams.

* * * * *